United States Patent [19]

Anderson et al.

[11] 4,437,544

[45] Mar. 20, 1984

[54] SERVICE PLATFORM FOR A LADDER

[75] Inventors: Harold R. Anderson, Winchester; Roland M. Hamilton, Groton, both of Mass.

[73] Assignee: The United States of America as represented by the Secretary of the Air Force, Washington, D.C.

[21] Appl. No.: 468,628

[22] Filed: Feb. 22, 1983

[51] Int. Cl.[3] ..... E06C 7/16; E06C 7/14

[52] U.S. Cl. ..... 182/120; 248/238

[58] Field of Search ..... 182/120, 121, 122; 248/210, 211, 238

[56] References Cited

U.S. PATENT DOCUMENTS

| | | | |
|---|---|---|---|
| 362,747 | 5/1887 | Higgins | 182/121 |
| 1,187,437 | 6/1916 | Lucas | 182/121 |
| 1,820,315 | 8/1931 | Miller | 182/120 |
| 1,943,626 | 1/1934 | Richard | 182/121 |
| 2,148,958 | 2/1939 | Myers | 182/120 |
| 2,151,135 | 3/1939 | Moberg | 182/121 |
| 2,486,783 | 11/1949 | Hartman | 182/120 |
| 3,067,836 | 12/1962 | Carnicelli | 182/121 |
| 3,294,197 | 12/1966 | Kwiatkowski | 182/120 |
| 4,306,700 | 12/1981 | Bell | 182/121 |

*Primary Examiner*—Reinaldo P. Machado

*Attorney, Agent, or Firm*—Donald J. Singer; Stanton E. Collier

[57] ABSTRACT

A service platform for a ladder has a ladder rung locking means that provides support for a frame member upon which a user stands. A scissor-like action is produced about a bearing wherein one lever arm is an extended arm attached to the frame and the other lever arm is a support lever connected directly to the other support lever by a support bar which rests upon the side rails of the ladder. The ladder rung is inserted into slots formed in the extended arms, the bearings, and in the support levers. Rotation of the frame causes the slots to become misaligned thereby locking the ladder rung therein. The service platform can be stored on the ladder without interfering with its use.

9 Claims, 5 Drawing Figures

SERVICE PLATFORM FOR A LADDER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to attachments for ladders, and, more particularly, to attachments for ladders for standing upon by the user.

A conventional ladder having either square or round rungs offers little comfort to a user who must stand on the ladder for numerous hours doing particular jobs. General types of platforms have been provided in the past but each type has disadvantages that make use difficult. Some types are only hooked over a rung and thus easily removed and are not usually stored on the ladder when not in use. Other types offer elaborate latching means for holding the platform to the ladder rung but usually are not stored on the ladder or if so, protrude either from the front or the back to possibly interfere with other objects.

These draw backs have motivated a search for a platform that minimizes the above difficulties.

SUMMARY OF THE INVENTION

The instant invention sets forth a service platform that attaches to a ladder rung in a manner that minimizes the problems set forth hereinabove.

The service platform has a box-shaped rectangular frame upon which a skid proof pad, a storage hook, and two extended arms are attached. Each extended arm has a rung slot therein; two c-shaped bearings having slots therein rotatably join the extended arms to support levers. The support levers have rung slots on the upper part that is rotatably attached to the bearing and a hole on the lower part for a support bar that is locked to each support lever. The selected rung acting as a bearing journal is simultaneously positioned into the extended arm rung slots, the c-shaped bearings slots and the lever rung slots when they are aligned for attaching the service platform to the ladder. The frame is rotated downwardly causing the support bar to contact the ladder side rails and stop thereon. The frame eventually comes to rest against the support bar. The rotation causes the extended arm rung slots and lever rung slots to lock about the rung.

It is therefore one object of the present invention to provide for a service platform that is easily mounted on a ladder rung and easily removed by one hand.

Another object of the present invention is to provide for a service platform that is securely attached to a ladder rung.

Another object of the present invention is to provide for a service platform that can be stored on the ladder without interfering with normal operation.

These and many other objects and advantages of the present invention will be readily apparent to one skilled in the pertinent art from the following detailed description of a preferred embodiment of the invention and related drawings.

DETAILED DESCRIPTION OF THE PREFERRED EMBODIMENT

Figure 1:
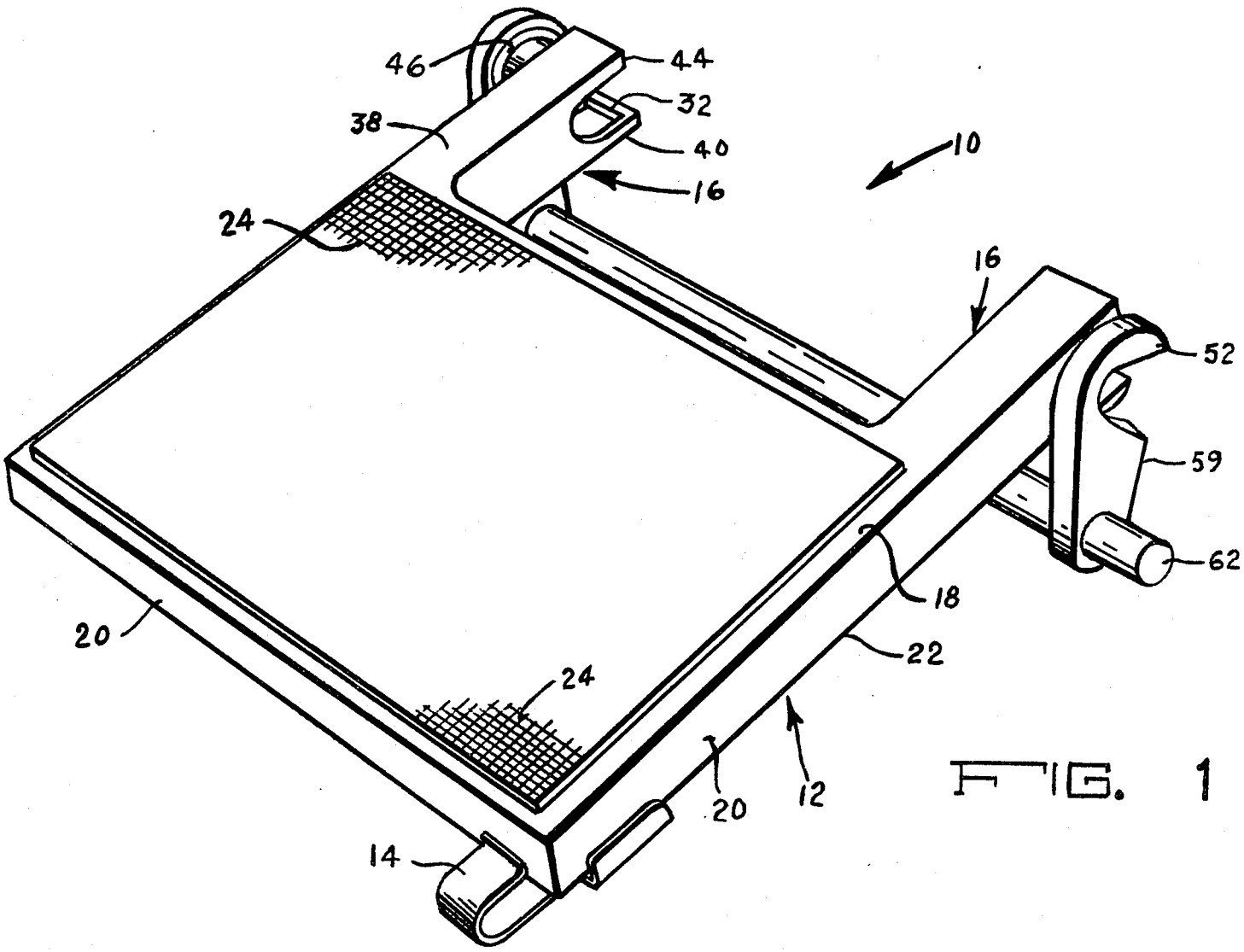
FIG. 1 is a pictorial representation of the service platform of the present invention.

Referring to FIG. 1, a service platform 10 is shown pictorially. The same reference numerals will be used in all the figures to identify identical elements.

Service platform 10 is constructed of a frame 12 that has a storage hook 14 and two extended arms 16 attached thereon. Frame 12 is made of preferably heavy sheet metal formed into a rectangular box-like structure having a top 18, four sides 20, only two shown, and a bottom 22, partially shown in FIGS. 2 and 5. Bottom 22 may be a solid sheet with a rectangular opening therein to lessen weight. Attached to top 18 is a skid proof pad 24 such as a corrugated sheet of rubber mat.

Figure 2:
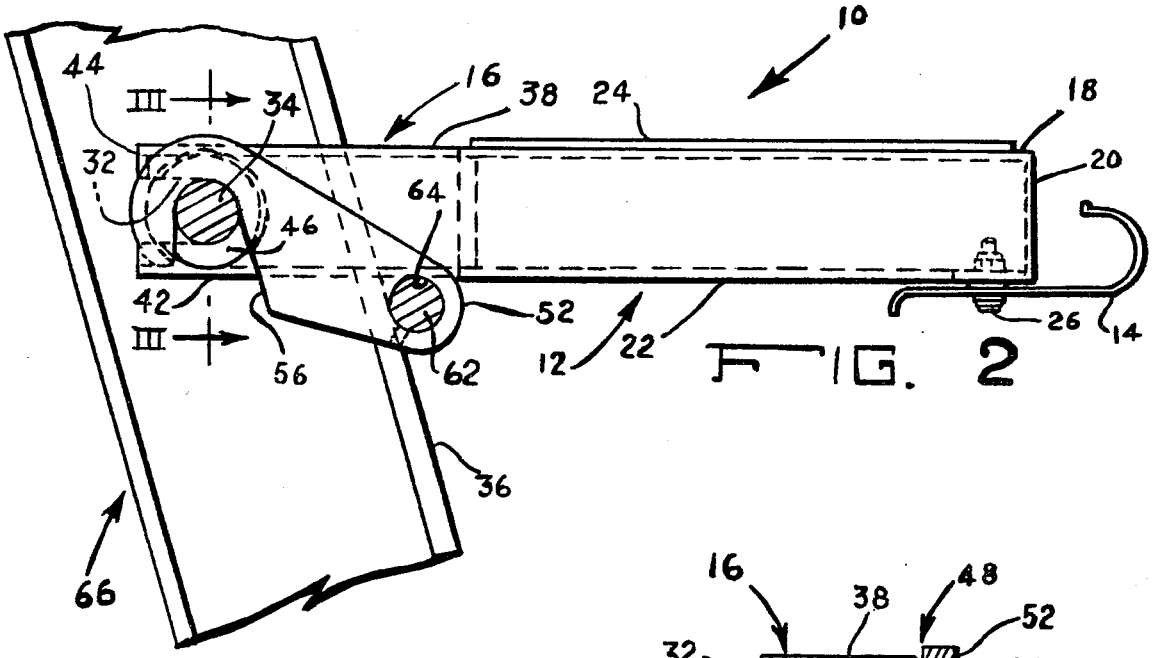
FIG. 2 is a side view of the present invention connected to one ladder rung and in contact with one side rail of the ladder.
Figure 5:
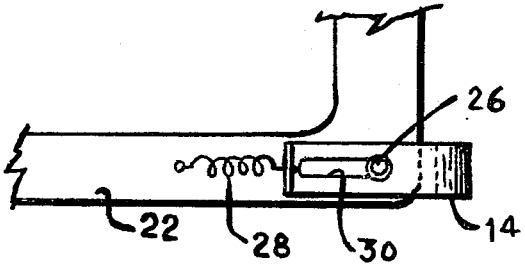
FIG. 5 is a view of the storage hook attached to the platform.

Storage hook 14 is attached to bottom 22 by a nut and bolt 26 as shown in FIG. 2. A bias spring 28 may be also attached to hook 14 as shown on FIG. 5. A slot 30 in hook 14 allows limited traverse movement of hook 14. By manual pressure, hook 14 can be moved to the right as shown in FIG. 5 to allow hook 14 to be engaged over the above rung for storage. This arrangement allows one handed operation to lower frame 12.

Extended arms 16 are made of the same material as frame 12 and are rectangular box-like structures. Preferably extended arms 16 are unitarily constructed with frame 12 for added strength by minimizing weld joints. A side view and a cross section view of extended arms 16 are shown in FIGS. 2 and 3, respectively.

On the ends of extended arms 16 opposite frame 12, rung slots 32, only one shown in FIG. 1, are formed therein to receive a rung 34 attached to side rails 36, only one shown, in FIG. 2 of a ladder 66. Each extended arm 16 has a top 38, sides 40, bottom 42, and a front end 44. Front end 44 has a rectangular opening therein slightly greater in height than the diameter of rung 34, and in width equal to the width of front end 44. The depth of rung slot 32 into sides 40 is about two diameters of rung 34 and the height is slightly greater than the diameter of rung 34. The rear surfaces of rung slots 32 are shaped as a half circle the diameter being slightly greater than rung 34 whether round, square, etc. shaped.

Centered on the above half circle are inner rings 46 of bearings 48. Rings 46 are welded to outer sides 40 as shown in FIGS. 1 and 3. Bearing 48 being a metal-to-metal bearing because of limited rotation has an outer ring 50 recessed into a support lever 52 shown in FIGS. 3 and 4 and inner ring 46 has a section removed that coincides with rung slot 38 to form a slot 54.

Figure 3:
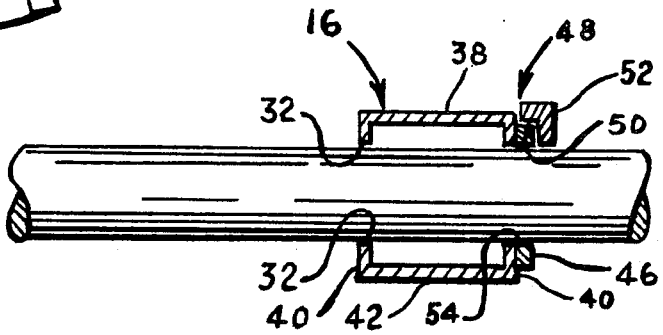
FIG. 3 is a partial cross section taken along lines III—III of FIG. 2 showing only one arm, one bearing, and one support lever of the present invention.
Figure 4:
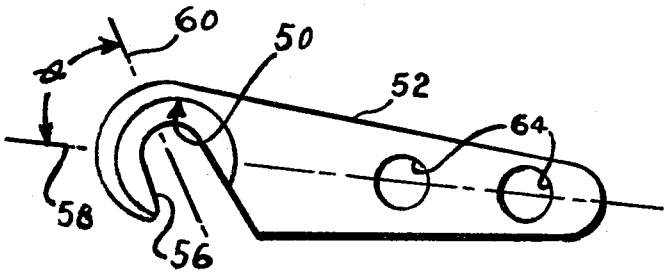
FIG. 4 is a side view of the support lever modified for multiple ladder angles.

Support levers 52, only one shown in FIGS. 2, 3 and 4 have rung slots 56 formed therein. The angle between a major axis 58 and a slot axis 60 of support levers 52 is about 75 degrees which corresponds to the compliment of the ladder inclination from the vertical. Rung slot 56 is shaped similarly to rung slot 32 of extended arms 16. Two support levers 52 are mounted so that recessed outer rings 50 are seated over inner rings 46 to form metal-to-metal bearings 48 and further have a support bar 62 inserted in bores 64, only one shown in FIG. 2, of levers 52 and held fixedly therein by set screws or cotter pins, for example.

Because of different possible ladder inclinations, a multiple set of bores 64 can be placed in levers 52 as shown in FIG. 4. Because of substantial torques applied by frame 12 to support bar 62 and levers 50, these structures must be made of heavy gauge metal and of stock of about half inch in diameter to insure safety considering a maximum load of about 300 pounds. Obviously, dimensions of frame 12, extended arms 16, levers 52, support bar 62 can be conventionally determined by standard principles of mechanics.

In operation, frame 12 of service platform 10 is lifted by one hand and held in a near vertical position where different slots, rung slots 32 of extended arms 16, slots 54 of bearings 48, and rung slots 56 of support levers 52, are aligned. Bearings 48 need not be a tight fitting thus allowing levers 52 and rod 62 to freely rotate about bearings 48. Rung 34 is then inserted into the slots and frame 12 is rotated in a downward direction. Support bar 62 comes to rest against side rails 36 of ladder 66 and subsequently extended arms 16 come to rest against support bar 62 so that support bar 62 is pinched between side rails 36 and bottoms 42 of extended arms 16. The above sequence causes rung slots 56 of support levers 52 to become unaligned with rung slots 32 of extended arm 16 and slots 54 of bearings 48 so that rung 34 is locked into the slots. Frame 12 may be raised when not in use and locked into the space between sides 36 and held there when hook 14 is placed over the above rung. Because of the space between frame 12 and rung 34, a user can still climb ladder 66 when service platform 10 is stored thereon.

Clearly, many modifications and variations of the present invention are possible in light of the above teachings and it is therefore understood, that within the inventive scope of the inventive concept, the invention may be practiced otherwise than specifically claimed.

What is claimed is:

1. A service platform for a ladder comprising:

a frame upon which a user stands;

a pair of extended arms fixedly attached to said frame, said extended arms having rung slots therein for receiving a ladder rung;

a bearing attached to each of said extended arms, said bearing having a slot therein for receiving said ladder rung;

a support lever attached to each of said bearings, said support levers having a rung slot therein for receiving said ladder rung and bore means therethrough; and a support bar attached to said support levers through said bores means.

2. A service platform for a ladder as defined in claim 1 wherein said frame has further attached therein a skid proof pad and a storage hook.

3. A service platform for a ladder as defined in claim 2 wherein said storage hook is spring biased to a closed position.

4. A service platform for a ladder as defined in claim 1 wherein said frame comprises a rectangular box-like structure having a partially open bottom composed of heavy gauge metal sheeting sufficient to withstand a load of about 300 pounds.

5. A service platform as defined in claim 1 wherein said extended arms comprise a rectangular box-like structure unitarly formed with said frame, said extended arms having said rung slot in ends opposite from said frame.

6. A service platform as defined in claim 1 wherein said bearings are metal-to-metal bearings having an inner ring with said bearing slot therein, said inner ring fixedly attached to said extended arms, and an outer ring formed in said support lever by a recessed ring.

7. A service platform as defined in claim 1 wherein said bore means includes at least one hole formed in said support lever, said hole being parallel to said ladder rung.

8. A service platform as defined in claim 1 wherein said support bar is attached to said support lever by means of set screw.

9. A service platform as defined in claim 1 wherein said support bar is attached to said support lever by cotter pins.

* * * * *